United States Patent [19]

Sorlien

[11] Patent Number: 4,960,481

[45] Date of Patent: Oct. 2, 1990

[54] LAMINATING METHOD

[75] Inventor: Mark D. Sorlien, St. Paul, Minn.

[73] Assignee: Minnesota Mining and Manufacturing Company, Saint Paul, Minn.

[21] Appl. No.: 367,233

[22] Filed: Jun. 16, 1989

Related U.S. Application Data

[62] Division of Ser. No. 312,718, Feb. 21, 1989, Pat. No. 4,929,029, which is a division of Ser. No. 57,214, May 8, 1987, Pat. No. 4,821,359.

[51] Int. Cl.[5] ..... B32B 31/20

[52] U.S. Cl. ..... 156/272.4; 34/9.5; 34/13.4; 34/13.8; 156/284; 156/308.2; 219/10.41; 219/10.61 R

[58] Field of Search ..... 156/272.2, 272.4, 273.5, 156/274.4, 274.6, 274.8, 72, 293, 284, 288, 305, 308.2; 219/10.41, 10.81, 10.69, 10.75, 10.53, 10.77, 10.57, 10.43, 10.61 R; 34/1, 4, 9.5, 13.4, 13.8, 16.5; 144/380, 381, 348, 349; 300/21; 206/362, 362.1; 15/159 A, 192, 159 R, 193, 143 R, 186, 187, 225, 223, 226, 209 R

[56] References Cited

U.S. PATENT DOCUMENTS

| | | | |
|---|---|---|---|
| 2,434,573 | 1/1948 | Mann | 156/274.8 |
| 2,705,993 | 4/1955 | Mann | 156/274.8 |
| 3,021,248 | 2/1962 | Mann | 156/274.6 |
| 3,232,809 | 2/1966 | Mann | 156/274.8 |
| 3,232,811 | 2/1966 | Coulter | 156/274.8 |
| 4,258,240 | 3/1981 | Pless | 219/10.69 |
| 4,402,781 | 9/1983 | Couture | 156/274.6 |
| 4,781,778 | 11/1988 | Olofsson | 156/196 |

*Primary Examiner*—Merrell C. Cashion, Jr.
*Attorney, Agent, or Firm*—Donald M. Sell; Walter N. Kirn; William L. Huebsch

[57] ABSTRACT

A brush including a laminate having a handle end portion adapted for manual engagement, and an opposite head end portion; and a plurality of rows of bristles having end portions adhered between adjacent plies in the head end portion of the laminate and projecting outwardly. The brush is formed from pieces of oriented polymeric film, portions of which are adhered to individual plies to be incorporated in the laminate and have portions projecting from the plies separated into bristles before the plies are laminated to form the brush. Lamination is done by driving moisture out of pasteboard layers coated with dried water activatable adhesive by exposure to radio freqeuncy energy which activates the adhesive to form the laminate.

3 Claims, 4 Drawing Sheets

LAMINATING METHOD

This is a division of application 07/312,718 filed 2/21/89, now U.S. Pat. No. 4,929,029, which is a division of Ser. No. 07/057,214 filed 5/8/87, now U.S. Pat No. 4,821,359.

TECHNICAL FIELD

The present invention relates to brush structures and to methods for manufacturing brushes.

BACKGROUND ART

Numerous structures have been described in the prior art as possible replacements for the conventional structure of a paint brush in which part or all of the structure is sufficiently inexpensive that it can be considered disposable after a single or a relatively few uses. Illustrative structures of this type are described in U.S. Pat. Nos. 2,265,274; 2,514,496; 3,094,729; 3,783,468; 3,874,021; and 4,155,139. No such known structure has become widely used, however, and for the most part the public continues to use conventional paint brushes of the type comprising a plurality of bristles ("bristles" as used herein includes filaments of polymeric material) having base end portions positioned along the sides of an elongate felt center spacer and a tubular ferrule typically of metal that receives the portions of the bristles along the sides of the center spacer in one end portion, has a resin such as epoxy poured into it to bond the bristles and center spacer in place, and then receives a portion of a handle, typically of wood or plastic in its other end portion so that the ferrule fastens the handle to the bristles. Such conventional paint brushes typically require a large amount of hand labor for their assembly, which adds significantly to their cost. Also, many lower cost conventional brushes incorporate polymeric bristles (e.g., polyester or nylon) many of which are made hollow to reduce their cost, and as a result will buckle more easily than solid bristles and will draw paint or other coatings into the bristles by capillary action that will not be removed when the brush is cleaned; and some of which are made with other than circular outer peripheries (e.g., generally triangular or cross like cross sections) to enhance the ability of their end portions to be flagged (i.e., split into smaller fibers) to improve their paint holding and spreading ability, and as a result have longitudinal recesses along their outer surfaces that have a tendency to retain paint when the brush is cleaned. Such retained paint in or on the bristles causes the bristles to lose some of their flexibility so that the brush is not as effective during reuse as it was when it was new.

Other types of brushes are manufactured by techniques such as wrapping the central portions of tufts of bristles around the central portions of staples and driving the staples into a backing member at the bottoms of recesses from one of its surfaces shaped so that walls defining the recesses position the bristles with their distal ends projecting at generally a right angle to the surface; or wrapping the central portions of bristles around a rod along its length and crimping a metal strip to a generally U cross sectional shape around those central portions and rod so that the distal portions of the bristles project in generally the same direction. Like the paint brush structures described above, however, manufacturing such other types of brushes requires working with individual bristles and require backings made from either molded plastics or wood.

DISCLOSURE OF INVENTION

The present invention provides a brush having a sufficiently inexpensive structure that it could be considered disposable by many, which brush can be manufactured by a largely automated method, and can be made as a brush adapted for applying paint or other architectural coatings that compares favorably in its ability to apply quality finishes to more expensive manually assembled conventional paint brushes with polymeric bristles and provides solid bristles with no recesses along their outer surfaces which can be easily and effectively flagged.

According to the present invention there is provided a brush comprising a plurality of similarly shaped plies (e.g., of chipboard) adhered together in face to face relationship to form a laminate, which laminate has a handle end portion adapted for manual engagement, and an opposite head end portion; and a plurality of rows of bristles, each row having a base end portion adhered between a different pair of adjacent plies in the head end portion of the laminate and having distal end portions projecting in the same direction outwardly from the head end portion, which distal end portions can be adapted to retain and apply paint or other architectural coatings such as stains and varnishes.

Preferably, the laminates of several such brushes are attached together at spaced locations along their edges to form a single plate like structure and are disposed with the head end portions of the laminates projecting in opposite directions; the head end portions of the laminates projecting in each direction being closely adjacent in side by side relationship, and the handle end portions of laminates projecting in one of the directions being interdigitated with the handle end portions of laminates projecting in the other of the directions. The laminates of such brushes are separable by breaking the spaced locations to separate individual ones of the brushes.

The method according to the present invention for forming such brushes comprising the steps of: (1) cutting (e.g., with a die) one or more sheets to form a plurality of plies each having a handle end portion and an opposite head end portion, the plies being attached together at spaced locations in a single layer and being disposed with the head end portions of the plies projecting in opposite directions, the head end portions of the plies projecting in each direction being closely adjacent in side by side relationship and having generally aligned end surfaces, and the handle end portions of plies projecting in one of the directions being interdigitated with the handle end portions of plies projecting in the other of the directions; (2) forming a plurality of pieces of fibrillatable oriented polymeric film having generally uniform lengths in the direction of orientation and including a first set of pieces having a width transverse to the direction of orientation generally corresponding to the total width of the head portions projecting in one direction and a second set of pieces having widths transverse to the direction of orientation generally corresponding to the total width of the head portions projecting in the other direction; (3) adhering one piece of film from each set to each of certain ones of the single layers with the end surfaces transverse to the direction of orientation and a minor end portion of one of the pieces of film overlaying and adhered to the head end portions of the plies projecting in one of the directions to which it corresponds in width, and a minor end portion of the other of the pieces of film overlaying and adhered to the head end portions of the plies projecting in the other of the directions and with major end portions of the pieces of film projecting from the head end portions in opposite directions; (4) separating the major end portions of the pieces of film adhered to the single layers into individual bristles; and (5) laminating the single layers together in aligned relationship with the minor end portions of the pieces of film laminated between the single layers to form a plurality of the brushes. Such brushes intended for applying paint or similar coatings such as varnish or stain can additionally have their distal tip end positions flagged (i.e., split into smaller fibers) and trimmed to produce a desired overall shape for the ends of the bristles.

Preferably the step of forming pieces of film comprises the steps of: (1) melting polymeric material comprising in the range of about 25% to 75% polyester and in the range of 75% to 25% polypropylene (preferably about 70% polyester and 30% polypropylene); (2) drawing a sheet of the molten polymeric material between surfaces, at least one of which surfaces is provided by a shaping blade that forms longitudinally extending ridges along one side portion of the sheet; (3) stretching the sheet (e.g., at a stretch ratio in the range of about 2.5 to 1 to 4 to 1) in the direction of the ridges to orient the film in a direction parallel to the ridges; and (4) cutting the pieces of polymeric film from the sheet of polymeric material. The portions of the sheet between the ridges provide break lines which facilitate separating the bristles from the pieces of film and the ridges provide rounded surfaces for one side of the separated bristles; and the plies are preferably laminated together so that the rounded surfaces of the bristles form both outer surfaces of the rows of bristles which provides a more conventional appearance for the brush.

The blend of polypropylene and polyester in the film made as described above provides a matrix of polyester with microfibers of polypropylene interspersed throughout. Those microfibers are generally oriented in the direction of the ridges due to shearing action in the shaping blade by which the ridges are formed, and the stretching of the film in the range of 2.5 to 1 to 4 to 1 indicated above further aligns the microfibers and decreases their brittleness and orients the film (e.g., stretching the film at a ratio of less than 2.5 to 1 was found to produce film that had a tendency to break during the separating step or when the tips of the bristles were flagged (i.e., split into smaller fibers), and it was difficult to stretch the film at a ratio of more than 4 to 1 due to the presence of the polyester). Those microfibers both (1) act as tearing lines within the film to enable the film to tear between the ridges during the separating step, and (2) form very fine tip fibers when tip portions of the bristles are flagged by high speed impact at room temperature, since at that temperature the relatively brittle polyester (which is not above its glass transition temperature and is thus brittle) will shatter leaving the relatively flexible polypropylene microfibers (which are above their glass transition temperature and are thus more flexible) in tact. Ridged film of 100 percent polypropylene has also been made using the method described above and was oriented by stretching the film in the direction of the ridges at a ratio of about 5 to 1. The bristles separated satisfactorily during the separating step, however the bristles could not be flagged as well as the bristles of the polypropylene and polyester blend, and thus would be more suitable for use in brushes of a type which do not require flagging (e.g., scrub brushes). Also, many other polymers and blends of polymers are known to form fibrillatable film that may be useful for making bristles in brushes using the method described above.

As illustrated, the separating step can comprise the steps of (1) providing an anvil having a generally planar support surface with a straight edge at least the length of the major end portions of the pieces of film parallel to the ridges; (2) moving the pieces of film attached to the plies along the support surface in a direction at a right angle to the ridges and to the straight edge and toward and over the straight edge with the portion of the major end portion of the piece of film on the anvil supported by the support surface; and (3) impacting and deflecting individual ridges out of the plane of the support surface as they leave the support surface to separate the film between the ridges and thereby form the bristles.

Preferably the individual plies are made of chipboard and have a coating of adhesive on one side that is dried prior to the step of laminating and is activatable by the application of moisture or heat; and the step of laminating comprises the steps of (1) exposing the plies to atmospheric moisture (i.e., preferably conditions of at least 20 percent or higher relative humidity at normal room temperature such as 68 degrees Fahrenheit), (2) pressing the adhesive coated plies together; and (3) radiating the pressed adhesive coated plies with radio frequency energy so that moisture in the chipboard is heated and driven from the chipboard to soften the adhesive so that the softened adhesive bonds the plies together.

BRIEF DESCRIPTION OF DRAWING

The present invention will be further described with reference to the accompanying drawing wherein like reference numerals refer to like parts in the several views, and wherein.

DETAILED DESCRIPTION

Figure 1:
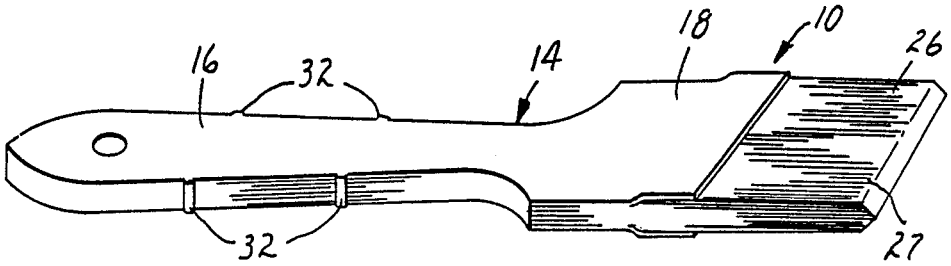
FIG. 1 is a perspective view of a brush according to the present invention.
Figure 2:
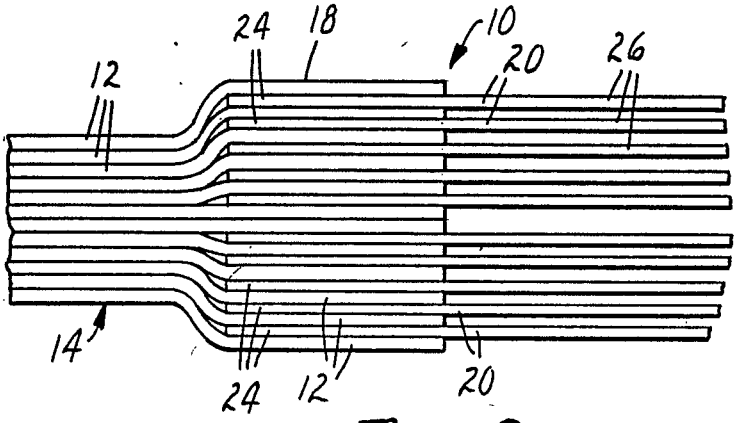
FIG. 2 is an enlarged fragmentary edge view of the brush of FIG. 1.

Referring now to FIGS. 1 and 2 of the drawing, there is shown a inexpensive brush according to the present invention, generally designated by the reference numeral 10, which is particularly adapted for applying paint and other architectural coatings.

Generally as is best seen in FIG. 2 the brush 10 comprises a plurality of similarly shaped plies 12 (e.g., of chipboard) adhered together in face to face relationship to form a laminate 14, which laminate 14 has a handle end portion 16 adapted for manual engagement, and an opposite head end portion 18; and a plurality of rows 20 of bristles, each row 20 having a base end portion 24 adhered between a different pair of adjacent plies 12 in the head end portion 18 of the laminate 14 and having distal end portions 26 projecting generally in the same direction outwardly from the head end portion 18 which have tip portions 27 that are flagged and shaped to help the bristles retain and apply paint or similar coatings.

Preferably, the bristles in each of the rows 20 of bristles are a blend of polypropylene and polyester, and because of the method for manufacturing the brush 10 described below, while the distal end portion 26 the bristles in each of the rows 20 are separated, those bristles are joined together in side by side relationship in the base end portion 24 of each row 20, which provides an extremely orderly array of bristles in the brush 10, and restricts pulling individual bristles from the laminate 14.

Figure 5:
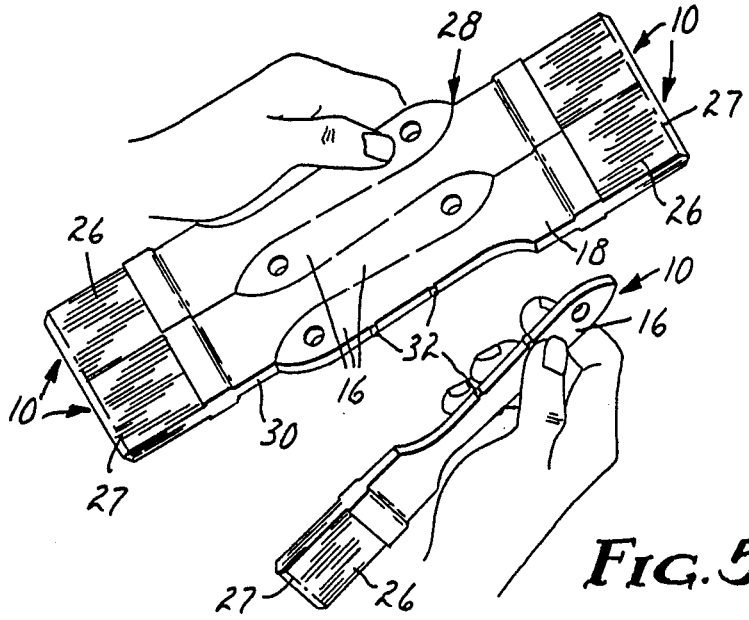
FIG. 5 is a reduced perspective view illustrating a user separating one of the brushes from the composite shown in FIG. 3.
Figure 3:
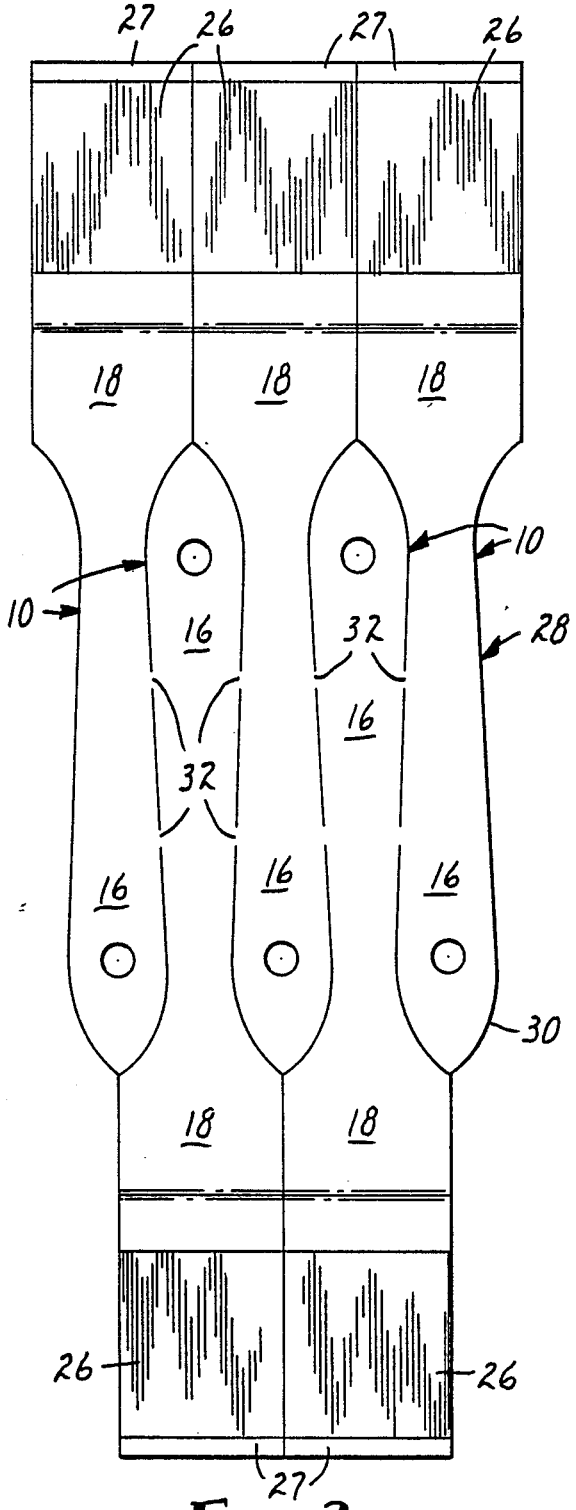
FIG. 3 is a horizontal top view of five of the brushes shown in FIG. 1 attached together in a composite.
Figure 4:
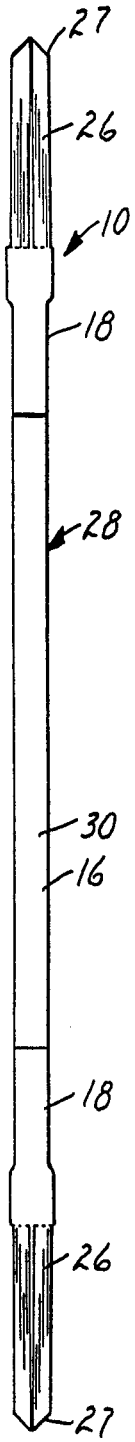
FIG. 4 is a vertical side view of the composite of five attached brushes shown in FIG. 3.

As illustrated in FIGS. 3, 4 and 5, the brush 10 is preferably manufactured in a composite 28 consisting of a plurality of (e.g.,five as illustrated) attached brushes 10 each having the structure described above with the laminates 14 of the brushes 10 being attached together at spaced locations 32 to form a single plate like structure 30 and being disposed with the head end portions 18 of the laminates 14 projecting in opposite directions; the head end portions 18 of the laminates 14 projecting in each direction being closely adjacent in side by side and edge to edge relationship, and the handle end portions 16 of laminates 14 projecting in one of the directions being interdigitated with the handle end portions 16 of laminates 14 projecting in the other of the directions. The laminates 14 are separable as illustrated in FIG. 5 by breaking the spaced locations 32 to separate individual ones of the brushes 10 from the composite 28.

A method for forming the brush 10 according to the present invention by forming the composite 28 is schematically illustrated in FIGS. 6 through 10. That method generally comprises the steps of (1) cutting (e.g., with a die, not shown) one or more sheets to form a plurality of the plies 12 (FIGS. 7A and 8A) each having a handle end portion 36 and an opposite head end portion 38, the plies 12 being attached together at spaced locations 39 in a single layer 40 and being disposed with the head end portions 38 of the plies 12 projecting in opposite directions, the head end portions 38 of the plies 12 projecting in each direction being closely adjacent in side by side relationship and having generally aligned end surfaces 42, and the handle end portions 36 of plies 12 projecting in one of the directions being interdigitated with the handle end portions 36 of plies 12 projecting in the other of the directions; (2) forming a plurality of pieces of oriented polymeric film (e.g., with the apparatus 43 illustrated in FIG. 6, later to be explained) having generally uniform lengths in the direction of orientation and including a first set of pieces 44 having a width transverse to the direction of orientation generally corresponding to the total width of the head portions 38 projecting in one direction and a second set of pieces 45 having widths transverse to the direction of orientation generally corresponding to the total width of the head portions 38 projecting in the other direction; (3) adhering one piece of the film from each set of pieces 44, 45 to each of certain ones of the single layers 40 (e.g., by using hot melt adhesive applied through a nozzle 47 as shown in FIGS. 7*a* and 8*a*) with a minor end portion 46 of one of the pieces 44, 45 of oriented film overlaying and adhered to the head end portions 38 of the plies 12 projecting in one of the directions to which it corresponds in width, and a minor end portion 46 of the other of the pieces 44, 45 of film overlaying and adhered to the head end portions 38 of the plies 12 projecting in the other of the directions and with the major end portions 48 of the pieces 44, 45 of film projecting from the head end portions 38 in opposite directions; (4) separating the major end portions 48 of the pieces 44, 45 of film adhered to the single layers 40 into individual bristles (e.g. with mechanisms 50 of the type shown in FIGS. 7A and 8A and best illustrated in FIG. 10, later to be described) so that widths of the pieces 44, 45 of film form the base and distal end portions 24 and 26 for the bristles of the individual brushes 10; (see FIG. 2) and (5) laminating the single layers 40 together in a press 52 FIGS. 7B and 8B) using the novel method described below with the minor end portions 46 of the pieces of film 44, 45 adhered to some of the single layers 40 laminated between the single layers 40 to form the composite 28 including a plurality of the brushes 10 each having the structure described above and being separable by breaking the spaced locations 32 to separate individual ones of the brushes 10.

As can best be seen in FIG. 2, the lamination is preferably done with two central layers 40 or plies 12 disposed with their surfaces opposite their surfaces to which the minor end portions 46 or base end portions 24 are adhered in contact, several layers 40 or plies 12 to which the minor end portions 46 or base end portions 24 are adhered on each side of those two central layers 40 or plies 12 (e.g., as illustrated, four on each side of the central two for a total of ten layers 40 or plies 12 to which minor end portions 46 or base end portions 24 are adhered), and two layers 40 or plies 12 to which no bristles are adhered before lamination forming the major outer surfaces of the composite 28 or laminate 14. These outer layers 40 may have words or pictures printed on their outer surfaces to provide, for example, information concerning the manufacturer of the brushes 10 or instructions for the separation and use of the brushes 10.

Figure 9:
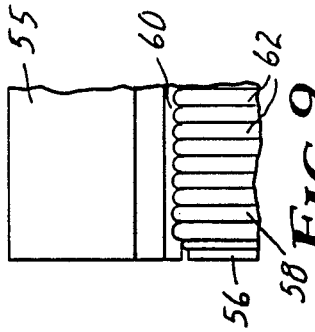
FIG. 9 is an enlarged fragmentary view taken approximately along line 9—9 of FIG. 6.
Figure 6:
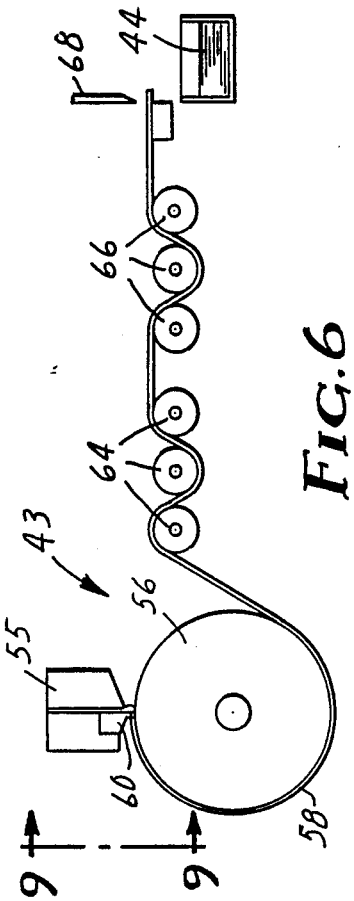
FIGS. 6, 7A and 7B schematically and sequentially illustrate, with side and plan views, a method according to the present invention for making the brush shown in FIG. 1 in the composite shown in FIG. 3.
Figure 7B:
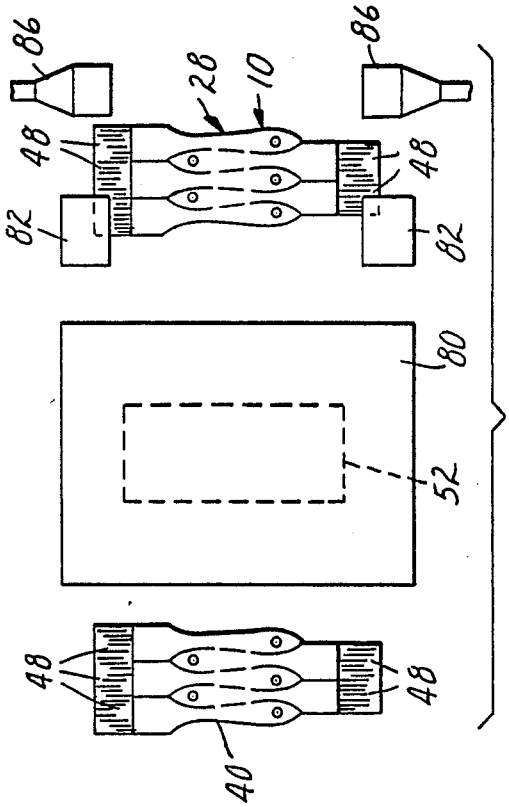
Figure 7A:
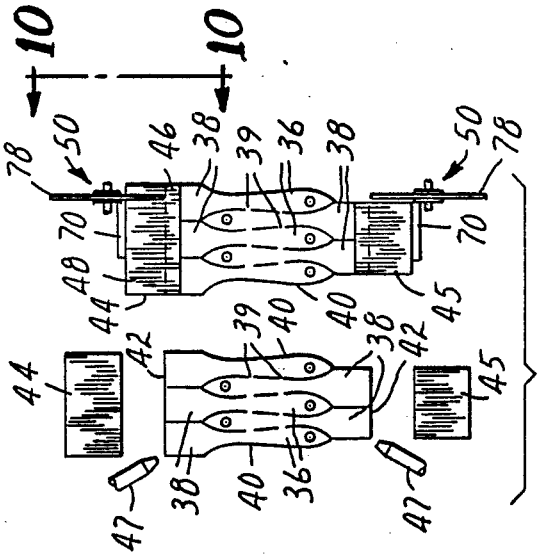
Figure 8B:
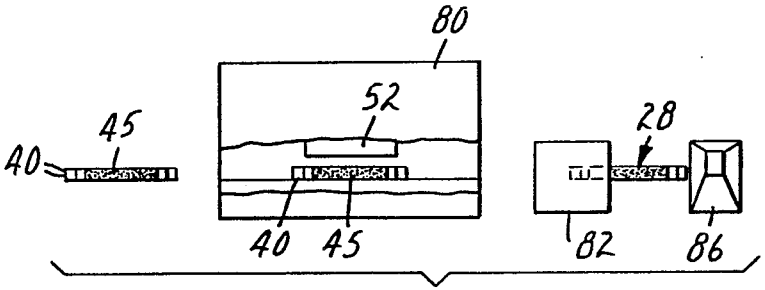
FIGS. 8A and 8B are schematic side views of the portions of the method according to the present invention shown in FIGS. 7A and 7B, respectively.
Figure 8A:
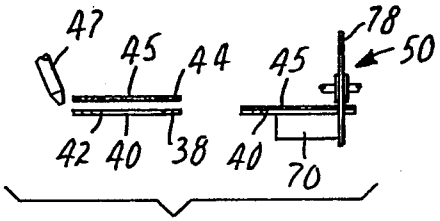

Preferably the step of forming pieces of film 44, 45 uses the apparatus 43 illustrated in FIG. 6 and 9 and comprises the steps of (1) melting polymeric material comprising in the range of 75% to 25% polyester and in the range of 25% to 75% polypropylene in an extruder (not shown) and expelling the melted polymeric material through a slot die 55 onto the polished surface of a cooled roller 56; (2) drawing a sheet 58 of the molten polymeric material between the surface of the roller 56 and a surface provided by a toothed shaping blade 60 that forms longitudinally extending arcuate ridges 62 along one side portion of the sheet 58; (3) stretching the sheet 58 (e.g., at a stretch ratio between about 2.5 to 1 and 4 to 1) in the direction of the ridges 62 as by passing it in serpentine fashion first around a set of heated rolls 64 to re-heat it, and then around a set of pulling rollers 66 rotating faster than the set of heated rollers 64 so that the sheet 58 is pulled between the sets of rollers 64 and 66 to orient the sheet 58; and (4) cutting the pieces 44, 45 of oriented polymeric film from the sheet 58 of polymeric material as with a cutter 68. Thin portions of the sheet 58 between the ridges 62 provide break lines between the ridges 62 to facilitate separating the bristles from the pieces 44, 45 of polymeric film and the ridges 62 provide rounded surfaces for one side of the bristles. Preferably the layers 40 or plies 12 are then laminated together so that the arcuate or rounded surfaces of the bristles form both outer surfaces of the rows 20 of bristles which provides a more conventional appearance for the brush.

Figure 10:
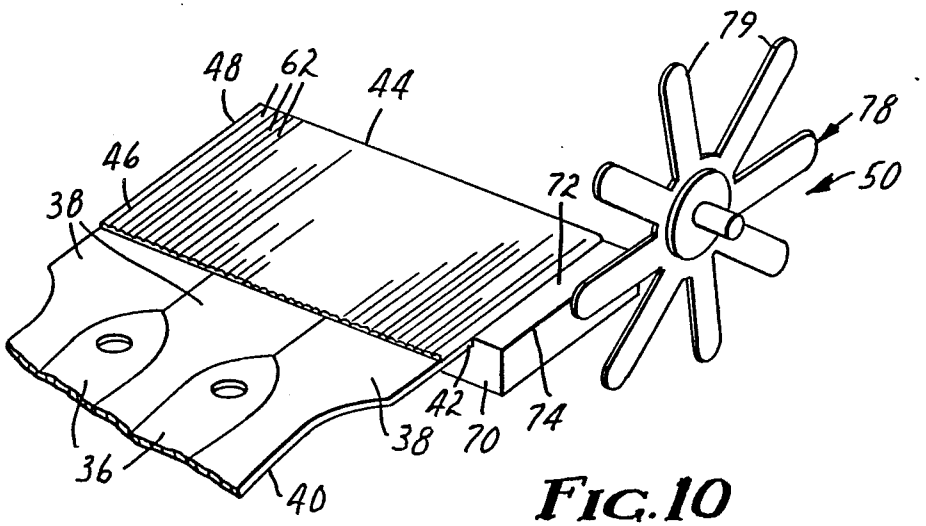
FIG. 10 is an enlarged fragmentary perspective view taken approximately along line 10—10 of FIG. 7A.

Preferably the separating step uses two of the mechanisms 50 best seen in FIG. 10, and comprises the steps of (1) providing an anvil 70 having a support surface 72 with a straight edge 74 at least the length of the major end portions 48 of the pieces 44, 45 of oriented film parallel to the ridges 62; (2) moving the pieces 44, 45 of oriented film attached to the layers 40 along the support surface 72 in a direction at a right angle to the ridges 62 and to the straight edge 74 and toward and over the straight edge 74 with the portion of the major end portion 48 of the piece 44 or 45 of film on the anvil 70 supported by the support surface 72; and (3) impacting and deflecting individual ones of the ridges 62 out of the plane of the support surface 72 as they leave the support surface 72 to separate the major end portion 48 of the piece 44 or 45 of film between the ridges 62 and thereby form the bristles. Such impacting can be done as illustrated with a rotating blade wheel 78 comprising a plurality of radially extending evenly circumferentially spaced blades 79 having sufficient widths axially of the blade wheel 78 to restrict axial deflection (e.g., 0.32 centimeter or ⅛ inch), which blade wheel 78 is rotated about an axis oriented at about a right angle to the straight edge 74 and is located with respect thereto so that the blades 79 will sequentially move through a position at which their leading edges are about aligned with the support surface 72, are parallel to and spaced less than the width of one of the bristles (e.g., 0.010 to 0.025 centimeter or 0.004 to 0.010 inch) from the straight edge 74, and project along the straight edge 74 almost to the end thereof along which the layer 40 is moved. The movement of the major end portions 48 over the straight edge 74 and the rate of rotation of the blade wheel 78 are timed so that each of the ridges 62 will be impacted by one of the blades 79 to be sure that each of the ridges 62 is separated into a bristle.

Preferably the individual plies 12 are made of chipboard and are coated on one side with water softenable polyvinyl alcohol adhesive which is dried prior to lamination (such adhesive coating and the die cutting of the individual plies 12 can be done on conventional equipment typically found in printing shops); and the step of laminating comprises the steps of (1) exposing the plies to atmospheric moisture (preferably conditions of at least 20 percent or higher relative humidity at normal room temperature, although exposures to lower relative humidities will work if more time is allowed for the radiating step); (2) pressing the adhesive coated plies together as with the press 52; and (3) radiating the pressed adhesive coated plies with radio frequency energy from a radio frequency generator 80 (e.g., 30 megahertz frequency) so that moisture in the chipboard is heated and driven from the chipboard into the adhesive (presumably through the uncoated surface of the chipboard into the contacting adhesive surface) to soften it so that the softened adhesive bonds the plies 12 together. Alternatively the individual plies 12 can be made of chipboard and coated on one side with a hot melt adhesive which is dried prior to lamination and the step of laminating can comprise the steps of (1) exposing the plies to atmospheric moisture; (2) pressing the adhesive coated plies together as with the press 52; and (3) radiating the pressed adhesive coated plies with radio frequency energy from a radio frequency generator 80 (e.g., 30 megahertz frequency) so that moisture in the chipboard is heated and driven from the chipboard (presumably through the uncoated surface of the chipboard into the contacting adhesive surface) to soften the adhesive so that the softened adhesive bonds the heated plies 12 together.

The method according to the present invention may further include the known brush making step of flagging the distal tip end portions 27 of the bristles to split them into many smaller fibers and thereby improve the ability of the bristles to spread paint and similar coatings very smoothly and evenly onto a surface. This step may be performed (as illustrated) by a commercially available flagging device 82 comprising cylindrically disposed forwardly hooked knives rotated at high speeds (e.g., 7000 to 8000 rpm) against the distal tip end portions 27 of the bristles after the laminating step so that the distal tip end portions 27 of all of the bristles in the brushes 10 are flagged in one pass. Alternatively this step may be performed just after the bristles are separated on each piece 44 or 45 of oriented film either with the flagging device 82, or by the novel method of impacting the distal tip end portions 27 of the bristles with the end portions of monofilaments (not shown), the other ends of which monofilaments are fastened to a rotating drum. Successful flagging by this latter method is more dependent on the percentages of polyester and polypropylene in the bristles than is flagging using the device 82, with 50% of each providing very acceptable results.

The profile of the distal tip end portions 27 of the bristles may be shaped so that, as illustrated, they are tapered from both sides toward the center of the brush 10. This can be done either by a novel method of cutting the major end portions 48 of the pieces 44 or 45 of film adhered to single layers 40 to different increasing lengths starting with the single layers 40 to be positioned adjacent the outer surface of the plate like structure 30 toward the single layers 40 to be used toward the center of the plate like structure 30, or by the known chiseling methods of trimming the distal end portions of the bristles of the brush 10 to a desired shape after the plate like structure 30 is formed through the use either of a shaped reciprocating cutter (not shown) similar to a barbers trimmer or a high speed rotary cutting head.

Also the bristles are preferably cleaned to remove broken or unbounded bristles either after the separating step or after the laminating step by combing through the bristles with wire carding cloth (not shown) and collecting the removed bristles through the use of a vacuum system 86. A rotating beater bar (not shown) can also be used in conjunction with the vacuum system 86 to remove broken or unbonded bristles and/or particles caused during separating and flagging of the bristles.

EXAMPLE

As a preferred non limiting example, the brush 10 was made by forming film of a blend of about 30% by weight polypropylene with a melt flow index of 12, about 70% polyester by weight with an intrinsic viscosity of 0.6, and about 0.1% sodium oleate by weight as a surfactant. As described above, the blend was melted in and discharged from the extruder, the molten polymeric material was drawn in a sheet 58 between surfaces including the polished cooled surface of the roll 56 and the toothed shaping blade 60 which had arcuate grooves between its teeth that formed ridges 62 on the sheet 58 so that the sheet 58 had a thickness of about 0.013 to 0.018 centimeter (0.005 to 0.007 inch) at the base of the grooves between the ridges 62, a distance of about 0.048 centimeter (0.019 inch) between the peaks of the ridges 62, and a thickness of about 0.061 to 0.069 centimeter (0.024 to 0.027 inch) at the peaks of the ridges 62. The sheet 58 thus produced was stretched in the direction of the ridges 62 at a ratio of about 3½ to 1 which changed the sheet 58 so that it had a thickness of about 0.003 to 0.005 centimeter (0.001 to 0.002 inch) at the base of the grooves between the ridges 62, a distance of about 0.038 to 0.046 centimeter (0.015 to 0.018 inch) between the peaks of the ridges 62, and a thickness of about 0.030 to 0.038 centimeter (0.012 to 0.015 inch) at the peaks of the ridges 62. Sheets of chipboard (i.e., 50% virgin kraft paper and 50% recycled newsprint) 0.02 inch thick and coated on one side with 18.3 grams per square meter of polyvinyl alcohol adhesive (e.g., that adhesive sold under the trade designation WB-3450 by H. B. Fuller Company, St Paul, Minn.) that had been dried were die cut to form the plies 12. These materials were used to form the composite 28 of brushes 10 in the preferred manner described above using twelve plies 12 and 10 rows 20 of bristles disposed as shown in FIG. 2 for each brush 10 (the outer plies 12 not having rows 20 of bristles adhered to them prior to lamination) which were pressed together at about 60 pounds per square inch and exposed to radio frequency of 30 megahertz for about 30 seconds from a transmitter having an estimated 4 kilowatts of power to complete the lamination. Each brush 10 was then flagged, shaped and cleaned. The brushes 10 were found to pick up a reasonable quantity of paint when dipped into the paint; to release a reasonable portion of the paint picked up on a surface being painted; and to provide a fairly thick uniform paint coating on that surface, with these qualities of the brush 10 being at least equal to such qualities of many brushes with synthetic bristles currently available in the marketplace which cost in the range of about one to two dollars.

The brush 10 and method for making the brush according to the present invention have now been described with reference to single embodiments thereof. It will be apparent to those skilled in the art that many changes can be made in the embodiments described without departing from the scope of the present invention. For example, the novel bristles made by the novel method described above may be useful in other brush structures having handle assemblies other than the laminate 14 described. Thus the scope of the present, invention should not be limited to the structure and method described in this application, but only by structures described by the language of the claims and the equivalents of those structures.

I claim:

1. A method of laminating comprising the steps of:
providing individual plies made of chipboard and coated with adhesive, which adhesive has been dried and is activatable by the application of water;
exposing the plies to atmospheric moisture so that the chipboard contains moisture;
pressing the adhesive coated plies together; and
radiating the pressed adhesive coated plies with radio frequency energy so that the moisture in the chipboard is heated and is driven from the chipboard into the adhesive to soften the adhesive and the softened adhesive bonds the plies together.

2. A method according to claim 1 wherein the adhesive is a water activatable polyvinyl alcohol adhesive.

3. A method of laminating comprising the steps of:
providing individual plies made of chipboard and coated with adhesive, which adhesive has been dried and is activatable by the application of heat;
exposing the plies to atmospheric moisture so that the chipboard contains moisture;
pressing the adhesive coated plies together; and
radiating the pressed adhesive coated plies with radio frequency energy so that the moisture in the chipboard is heated and is driven from the chipboard to heat and soften the adhesive and the softened adhesive bonds the plies together.

* * * * *